US012193523B2

(12) United States Patent
Lin

(10) Patent No.: US 12,193,523 B2
(45) Date of Patent: Jan. 14, 2025

(54) BRA WITH ADJUSTABLE INNER CUPS

(71) Applicant: Zigan Lin, Shenzhen (CN)

(72) Inventor: Zigan Lin, Shenzhen (CN)

( * ) Notice: Subject to any disclaimer, the term of this patent is extended or adjusted under 35 U.S.C. 154(b) by 0 days.

(21) Appl. No.: 18/606,180

(22) Filed: Mar. 15, 2024

(65) Prior Publication Data

US 2024/0277079 A1 Aug. 22, 2024

(51) Int. Cl.
*A41C 3/00* (2006.01)

(52) U.S. Cl.
CPC ..... *A41C 3/0028* (2013.01)

(58) Field of Classification Search
CPC ..... A41C 3/0028
USPC ..... 450/78
See application file for complete search history.

(56) References Cited

U.S. PATENT DOCUMENTS 7,407,430 B1 * 8/2008 Wanzenbock ..... A41C 3/02 450/82
8,177,602 B1 * 5/2012 Kaytes ..... A41C 3/0028 450/60
9,554,599 B2 * 1/2017 Balland ..... A41C 3/0028
11,641,889 B2 * 5/2023 Eldreth ..... A41C 3/0057 450/1
11,805,823 B1 * 11/2023 Browning ..... A41C 3/005
2011/0275277 A1 11/2011 Martins-Crawbuck et al.
2013/0109276 A1 * 5/2013 Sporn ..... A41C 3/10 450/57
2014/0259301 A1 * 9/2014 Berns ..... A43C 9/00 2/336
2014/0349550 A1 * 11/2014 Campbell ..... A41C 3/0021 450/60
2015/0079876 A1 3/2015 Betts
2016/0338420 A1 11/2016 Betts
2024/0180265 A1 * 6/2024 Lai ..... A41C 3/0028

* cited by examiner

*Primary Examiner* — Gloria M Hale
(74) *Attorney, Agent, or Firm* — Hemisphere Law, PLLC; Zhigang Ma

(57) ABSTRACT

A bra with adjustable inner cups comprises a bra body. The bra body is provided with two inner cups and an adjustment assembly. The adjustment assembly comprises a shell, a take-up assembly and an adjustment band. The bra body has an outer fabric layer and an inner fabric layer, the two inner cups are arranged between the outer fabric layer and the inner fabric layer, and the outer fabric layer and the inner fabric layer are both made from modified cellulose fibers. The adjustment band is a metal adjustment band or a nylon adjustment band.

6 Claims, 12 Drawing Sheets

BRA WITH ADJUSTABLE INNER CUPS

BACKGROUND OF THE INVENTION

Technical Field

The disclosure relates to a bra with adjustable inner cups.

Description of Related Art

Background information related to the invention is stated here, but the background information does not necessarily constitute the prior art.

Existing bras are adjusted generally by means of hooks and eyes. However, such an adjustment method is complex and inconvenient to operate. There are also some bras allowing the distance between cups to be controlled and adjusted by rotation. However, such bras also have some drawbacks. For example, the unreasonable arrangement of an adjustment band leads to an unsatisfactory adjustment effect. In addition, existing bras are not-satisfactory enough in fabric selection and structural design, resulting in poor sweat absorbency and comfort.

Therefore, it is necessary to provide a new technical solution to solve the above problems.

BRIEF SUMMARY OF THE INVENTION

To overcome the defects and drawbacks in the prior art, the invention provides a bra with adjustable inner cups. By means of a specific arrangement of the bra, wearers wearing the bra do not need to take off the bra repeatedly for adjustment when the tightness of the bra is improper, and can adjust the bra to desired tightness by directly rotating a rotary buckle, such that operation is easy, the time for putting on and adjusting the bra is greatly shortened; and the bra provided by the application has the advantage of better wearing comfort.

To fulfill the above objective, the invention adopts the following technical solution:

A bra with adjustable inner cups comprises a bra body, wherein the bra body is provided with two inner cups and an adjustment assembly for adjusting a distance between the two inner cups, and the adjustment assembly comprises a shell, a take-up assembly and adjustment band; a rotary buckle is rotatably arranged at a top of the shell; the take-up assembly comprises an adjustment rod and a reel; the adjustment rod is rotatably arranged in the shell, and a top end of the adjustment rod is connected to the rotary buckle; the adjustment rod is in transmission connection with the reel, and two ends of the adjustment band are connected to the reel; a band body of the adjustment band is connected in series to the two inner cups;

the bra body has an outer fabric layer and an inner fabric layer, the two inner cups are arranged between the outer fabric layer and the inner fabric layer, and the outer fabric layer and the inner fabric layer are both made from modified cellulose fibers; and the adjustment band is a metal adjustment band or a nylon adjustment band.

In some embodiments, the shell comprises a bottom shell and a top shell; the top shell covers the bottom shell; the rotary buckle is rotatably arranged on the top shell; a bottom of the adjustment rod is rotatably arranged on the bottom shell, and a top of the adjustment rod penetrates through the top shell to be in transmission connection with the rotary buckle; and a bottom of the reel is rotatably arranged on the bottom shell.

In some embodiments, a transmission socket is arranged at a top of the top shell, and a limiting bump is arranged in the transmission socket; a plurality of limiting grooves are formed in a bottom of the rotary buckle in a circumferential direction; the limiting bump is slidably clamped in one of the limiting grooves; a V-shaped hole is formed in the transmission socket; the limiting bump is located on an inner side of a vertex of the V-shaped hole;

a band slot is formed in a side of the reel and provided with a seam connected to a track of the reel; the two ends of the adjustment band are both arranged in the band slot; and when the adjustment band is installed, the ends of the adjustment bands are knotted and then clamped in the band slot in an interference manner, then the adjustment band penetrates through the seam, and when taken up, the adjustment band rotates to be wound around the track of the reel.

In some embodiments, first openings for placing in and taking out the inner cups are formed in an inner side of the bra body, and a second opening for placing in and taking out of the rotary buckle is formed in the bra body;

the bra body further comprises a bottom trim and hooks and eyes, the bottom trim is made from an elastic fabric, connecting portions are arranged between the cup bodies and the hooks and eyes, and air holes are formed in the connecting portions.

In some embodiments, decorative lace is arranged at the second opening of the bra body.

In some embodiments, massage protrusions are arranged on inner sides of the inner cups in a fan shape, and the massage protrusions are strip-shaped or spindle-shaped.

Compared with the prior art, the invention has remarkable advantages and beneficial effects. Specifically, as can be known from the above technical solution, by means of the specific arrangement of the bra, wearers wearing the bra do not need to take off the bra repeatedly for adjustment when the tightness of the bra is improper, and can adjust the bra to desired tightness by directly rotating the rotary buckle, such that operation is easy, the time for putting on and adjusting the bra is greatly shortened; and the bra provided by the application has the advantage of better wearing comfort To more clearly expound the structural features and effects of the invention, the invention will be described in detail below in conjunction with accompanying drawings and specific embodiments.

REFERENCE SIGNS

Figure 1:
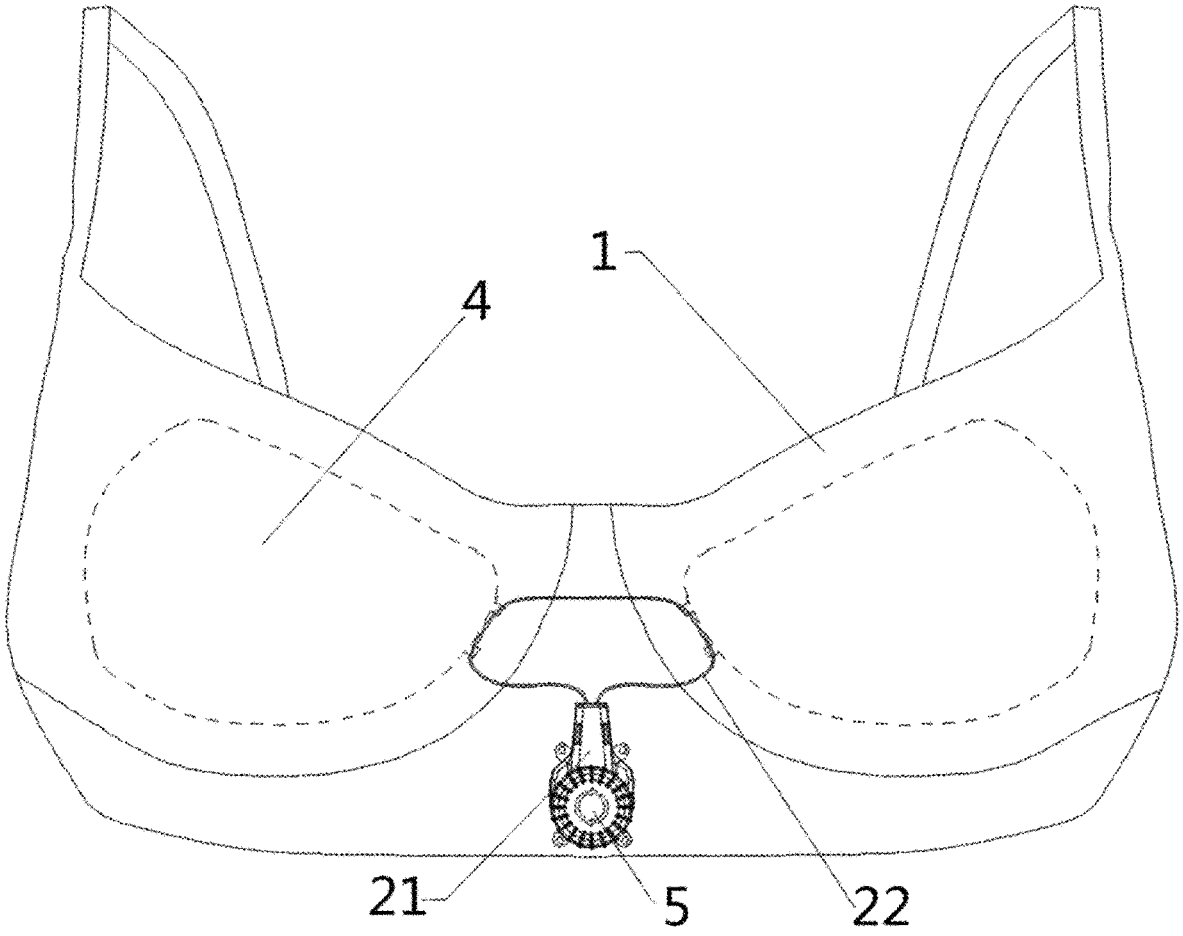
FIG. 1 is a schematic structural view of Embodiment 1 of the invention.
Figure 2:
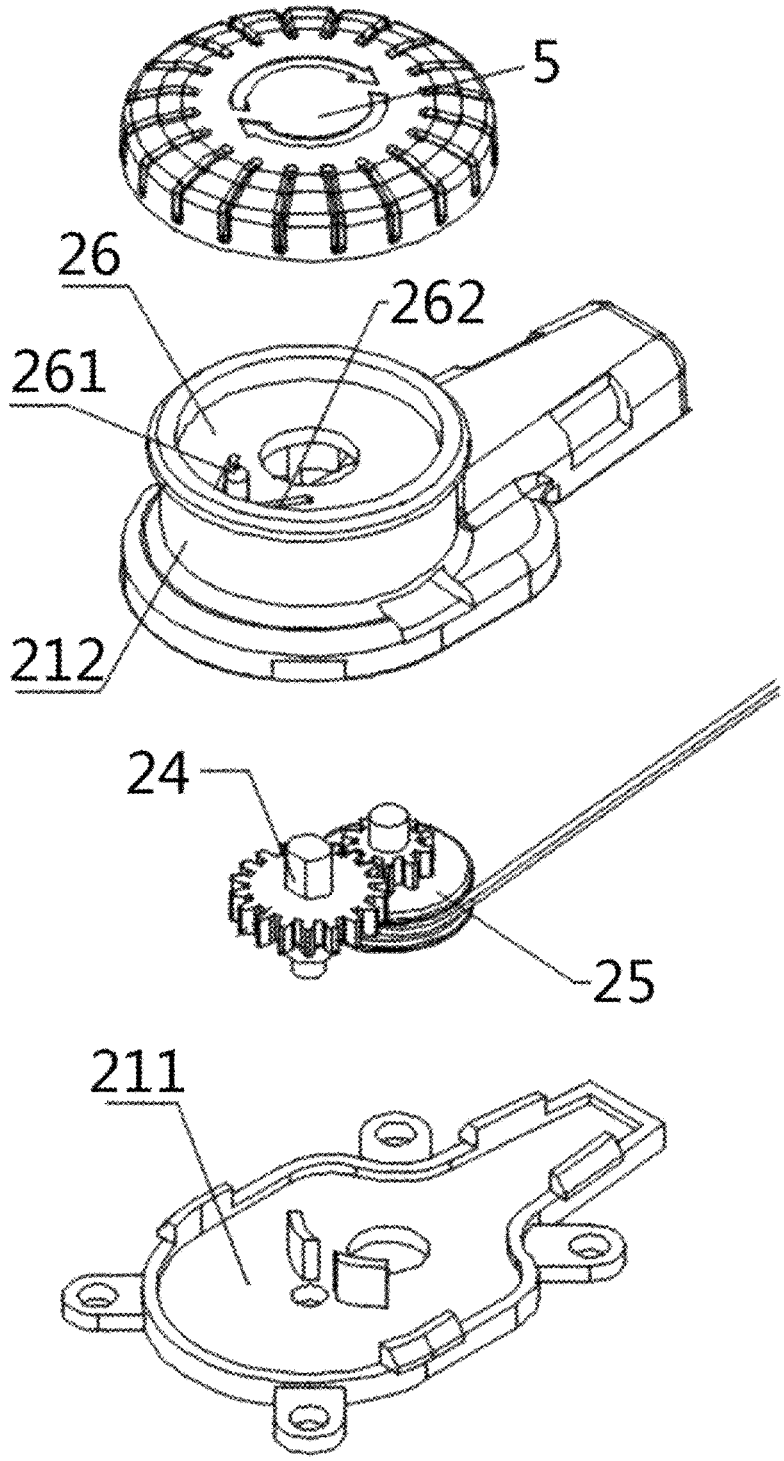
FIG. 2 is a schematic exploded view of an adjustment assembly in Embodiment 1 of the invention.
Figure 3:
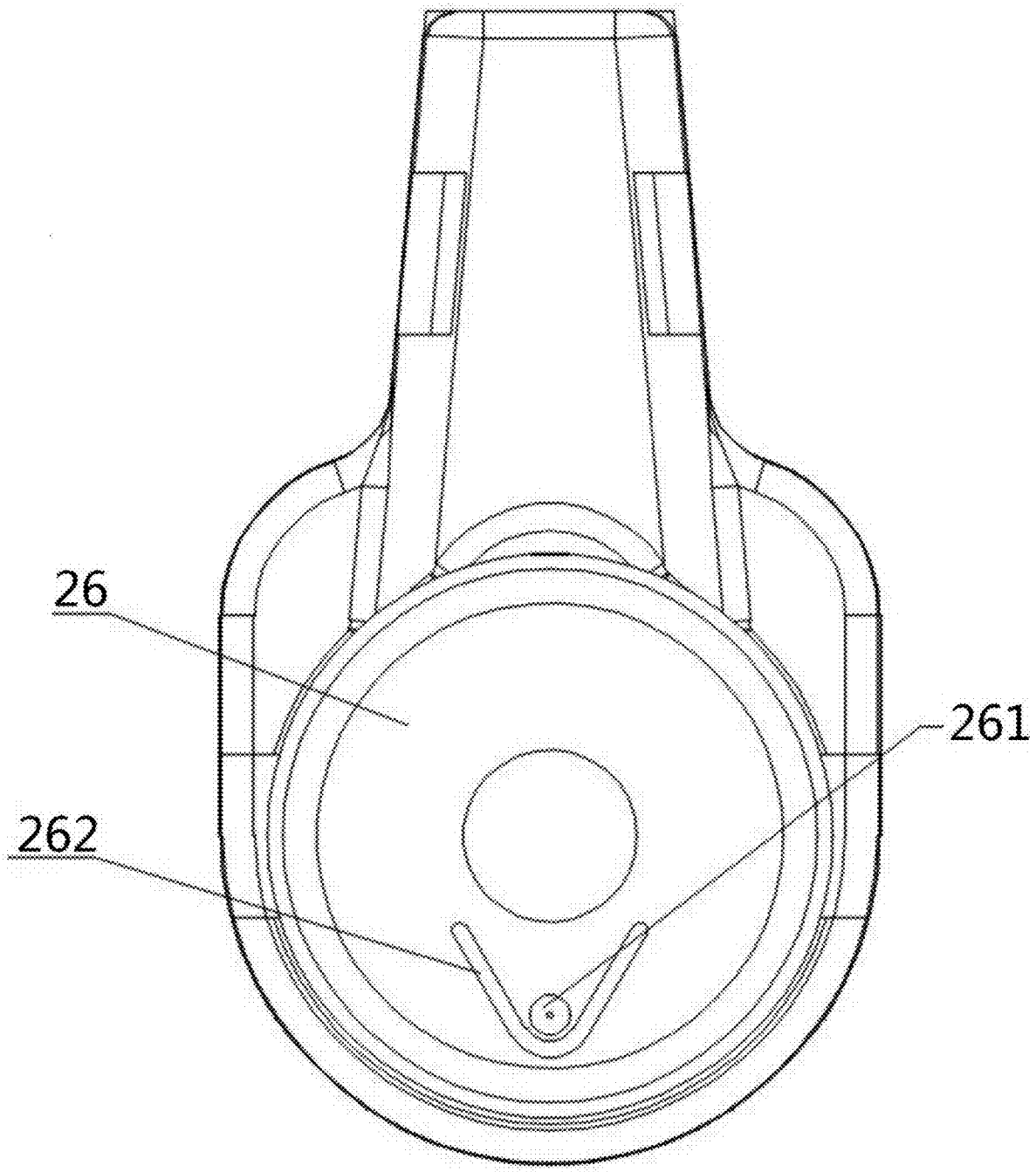
FIG. 3 is a schematic structural view of a top shell in Embodiment 1 of the invention.
Figure 4:
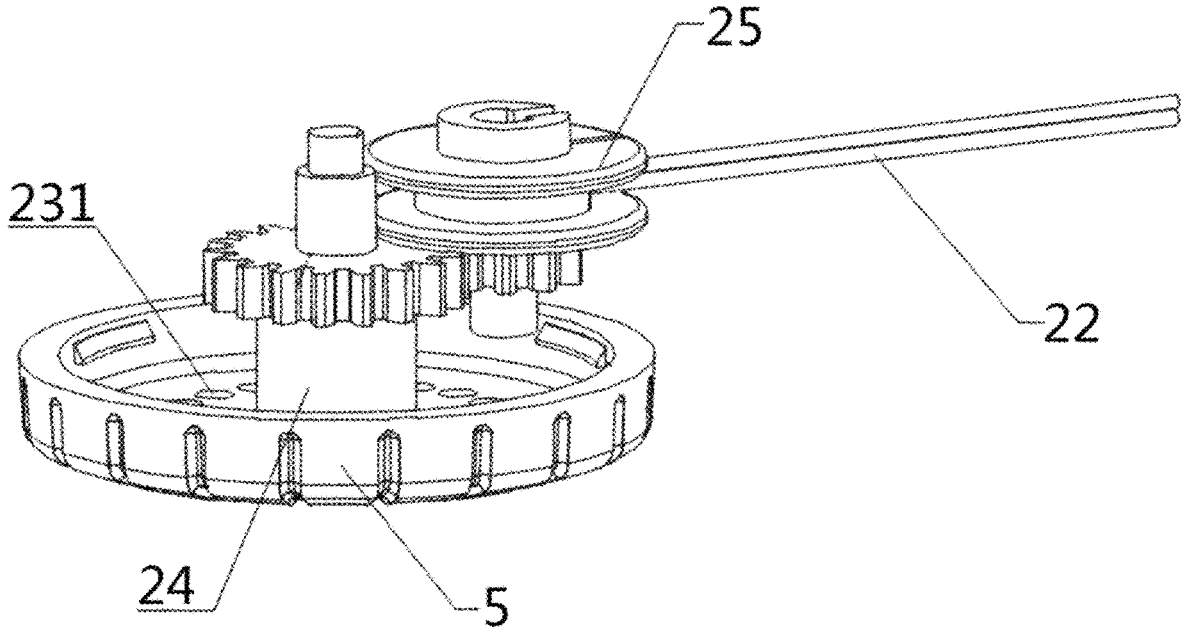
FIG. 4 is a partial structural view of the adjustment assembly in Embodiment 1 of the invention.
Figure 5:
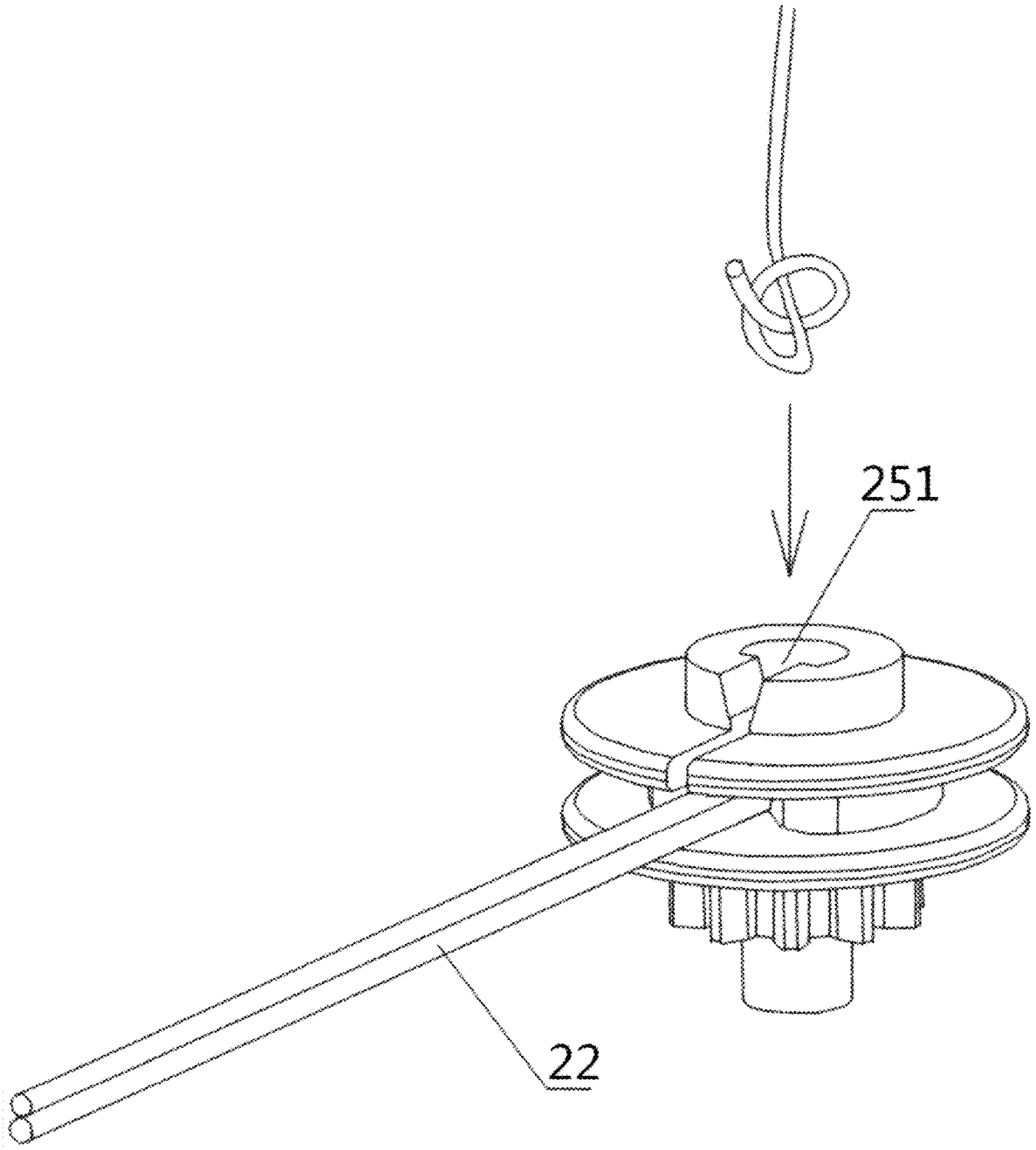
FIG. 5 is an installation diagram of an adjustment band in Embodiment 1 of the invention.

1, bra body; 2, strap; 3, cup body; 4, inner cup; 5, rotary buckle; 7, first opening; 8, second opening; 9, bottom trim; 10, hook and eye; 11, connecting portion; 12, air hole; 13, lining; 14, massage protrusion; 21, shell; 211, bottom shell; 212, top shell; 22, adjustment band; 231, limiting groove; 24, adjustment rod; 25, reel; 251, band slot; 26, transmission socket; 261, limiting bump; 262, V-shaped hole.

DETAILED DESCRIPTION OF THE INVENTION

The technical solutions of the embodiments of the invention will be clearly and completely described below in conjunction with accompanying drawings. Obviously, the embodiments in the following description are merely preferred ones of the invention.

It should be noted that when one element is referred to as being "fixed to" the other element, it may be directly fixed to the other element or there may be an element between these two elements. When one element is referred to as being "connected to" the other element, it may be directly connected to the other element or there may be an element between these two elements. Terms such as "vertical", "horizontal", "left" and "right" and similar expressions in the specification are merely for the purpose of description and do not indicate a unique implementation.

Unless otherwise defined, all technical and scientific terms used in the specification have the same meanings as commonly understood by those skilled in the art. All the terms used in the description of the invention are merely for the purpose of describing specific implementations and are not intended to limit the invention. The term "and/or" used in the specification refers to the inclusion of any one and all combinations of one or more items listed.

Embodiment 1

As shown in FIG. 1-FIG. 5, a bra with adjustable inner cups comprises a bra body 1, wherein the bra body 1 is provided with two inner cups 4 and an adjustment assembly for adjusting the distance between the two inner cups 4, and the adjustment assembly comprises a shell 21, a take-up assembly and an adjustment band 22; a rotary buckle 5 is rotatably arranged at the top of the shell 21; the take-up assembly comprises an adjustment rod 24 and a reel 25; the adjustment rod 24 is rotatably arranged in the shell 21, and a top end of the adjustment rod 24 is connected to the rotary buckle 5; a bull gear is arranged on an outer side of the adjustment rod 24; the reel 25 is rotatably arranged in the shell 21; a pinion gear in meshing transmission with the bull gear is arranged at the bottom of the reel 25; two ends of the adjustment band 22 are connected to the reel 25; and a band body of the adjustment band 22 are connected in series to the two inner cups 4 respectively.

Specifically, the shell 21 comprises a bottom shell 211 and a top shell 212; the top shell 212 covers the bottom shell 211; the rotary buckle 5 is rotatably arranged on the top shell 212; the bottom of the adjustment rod 24 is rotatably arranged on the bottom shell 211, and the top of the adjustment rod 24 penetrates through the top shell 212 to be in transmission connection with the rotary buckle 5; and the bottom of the reel 25 is rotatably arranged on the bottom shell 211.

Specifically, a transmission socket 26 is arranged at the top of the top shell 212, and a limiting bump 261 is arranged in the transmission socket 26; a plurality of limiting grooves 231 are formed in the bottom of the rotary buckle 5 in a circumferential direction; and the limiting bump 261 is slidably clamped in one of the limiting grooves 231. Through the interference sliding fit between the limiting bump 261 and the limiting grooves 231, wearers need to apply a force to rotate an adjustment button, and a failure to adjust the inner cups 4 caused by looseness of the adjustment button is avoided.

Specifically, a V-shaped hole 262 is formed in the transmission socket 26, and the limiting bump 261 is located on an inner side of a vertex of the V-shaped hole 262. By means of the V-shaped hole 262, a portion, where the limiting bump 261 is located, of the transmission socket 26 forms an elastic structure, and the limiting bump 261 is in elastic contact with the bottom of the rotary buckle 5, thus reducing abrasion caused by rotation of the limiting bump 261.

Specifically, a band slot 251 is formed in one side of the reel 25 and provided with a seam connected to a track of the reel 25; and the two ends of the adjustment band 22 are both arranged in the band slot 251. When the adjustment band 22 is installed, the ends of the adjustment band 22 are knotted and then clamped in the band slot 251 in an interference manner, then the adjustment band 22 penetrates through the seam, and when taken up, the adjustment band 22 is rotated to be wound around the track of the reel 25.

Embodiment 2

Figure 6:
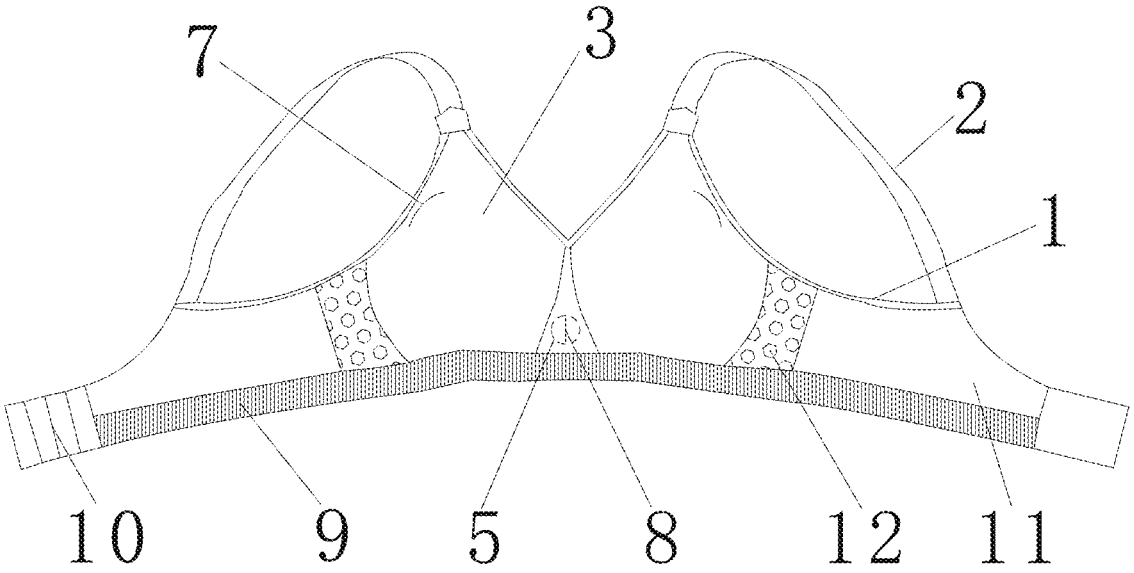
FIG. 6 is a first schematic structural view of Embodiment 2 of the invention.
Figure 7:
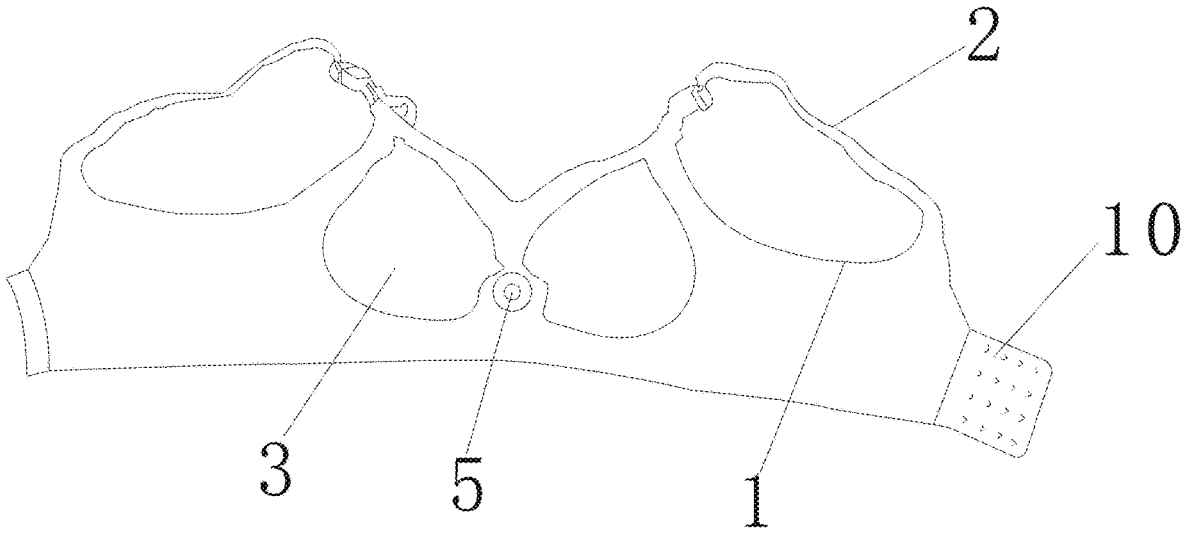
FIG. 7 is a second schematic structural view of Embodiment 2 of the invention.

As shown in FIG. 6 and FIG. 7 which illustrate the structure of a bra in Embodiment 2. The bra in Embodiment 2 is suitable for lactating women and is approximately identical in structure with Embodiment 1 (adopting the adjustment structure for the inner cups). Specifically, the bra in this embodiment comprises a bra body 1 and straps 2, wherein the bra body 1 comprises cup bodies 3, and the bra body 1 has an outer fabric layer and an inner fabric layer; and the inner cups 4 are located between the outer fabric layer and the inner fabric layer. Preferably, first opening 7 for placing in and taking out the inner cups 4 are formed in inner sides of the cup bodies 3, and a second opening 8 for placing in and taking out the rotary buckle 5 is formed between the two cup bodies 3.

Further, the bra body 1 further comprises a bottom trim 9 and hooks and eyes 10, wherein the bottom trim 9 is made from an elastic fabric, connecting portions 11 are arranged between the cup bodies 3 and the hooks and eyes 10, and the bottom trim 9 is arranged at bottoms of the connecting portions 11 and the cup bodies 3.

In actual use, the inner cups 4 are placed between the outer fabric layer and the inner fabric layer by means of the first openings 7 and are connected by means of the adjustment band 22, and wearers put on the bra by means of the hooks and eyes 10; if the tightness of the bra is improper, the wearers can rotate the rotary buckle 5 to pull the adjustment band 22 to adjust the distance between the two inner cups 4 so as to adjust the tightness of the bra until the wearers feel comfortable.

Preferably, decorative lace is arranged at the second opening 8 to cover the second opening 8 so as to make the bra aesthetic and comfortable. Preferably, air holes 12 are formed in the connecting portions 11 on outer sides of the cup bodies 3 to improve breathability, thus avoiding stuffiness.

Embodiment 3

Figure 8:
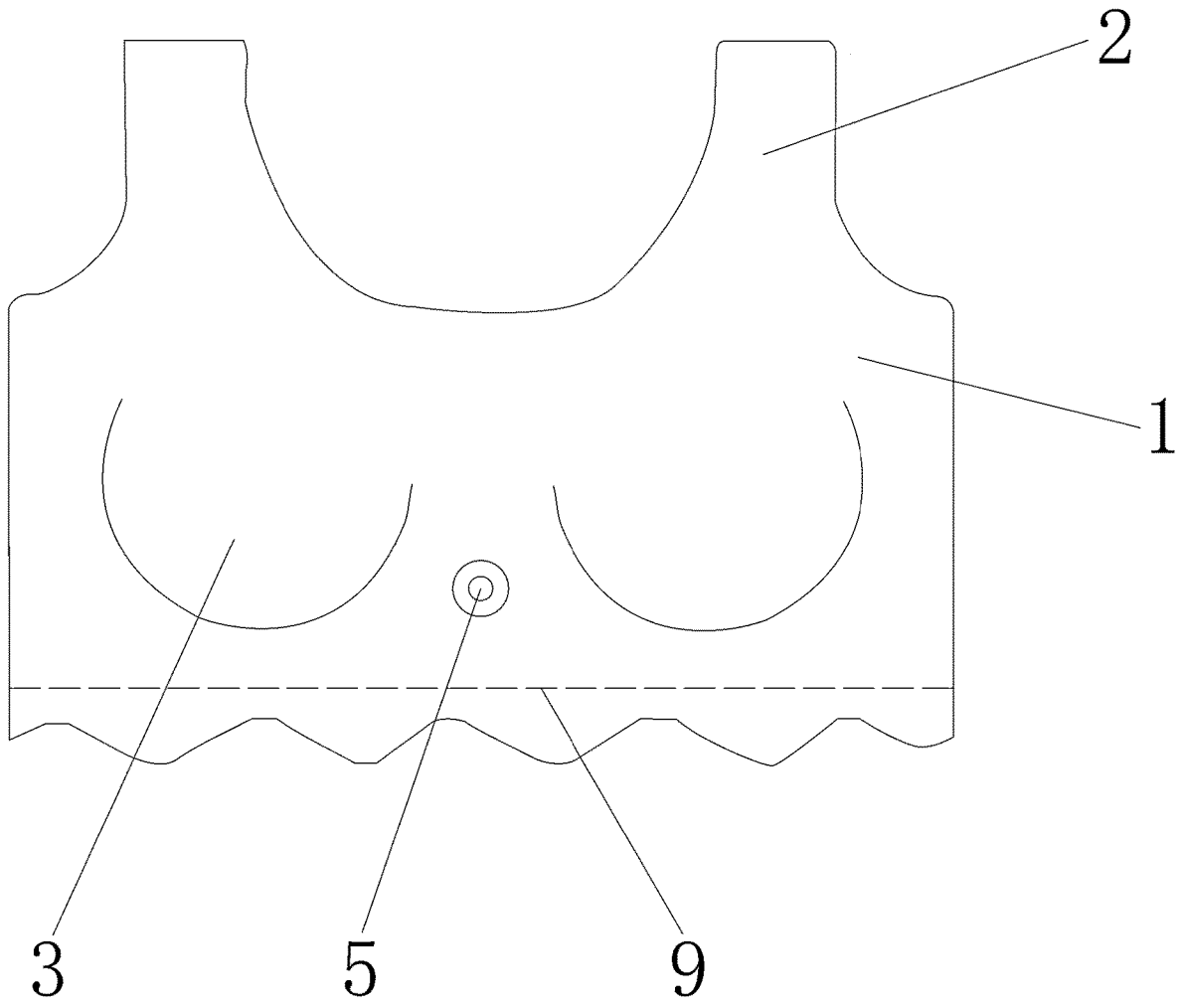
FIG. 8 is a first schematic structural view of Embodiment 3 of the invention.
Figure 9:
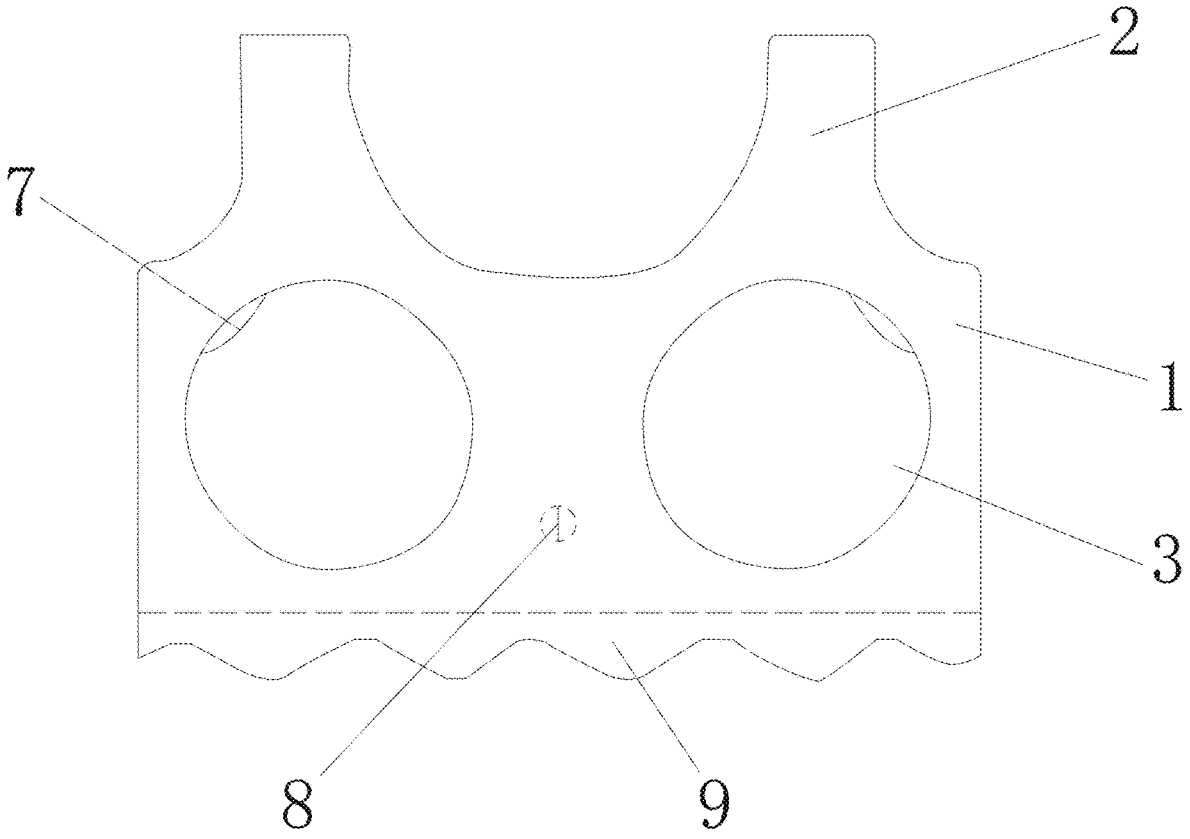
FIG. 9 is a second schematic structural view of Embodiment 3 of the invention.

As shown in FIG. 8 and FIG. 9 which illustrate the structure of a bra in Embodiment 3. The bra in Embodiment 3 is suitable for women during exercise and is approximately identical in structure with Embodiment 1 (adopting the adjustment structure for the inner cups). Specifically, the bra in this embodiment comprises a bra body 1 and straps 2, wherein the bra body 1 and the straps 2 are made from elastic fabrics, and the bra body 1 has an outer fabric layer and an inner fabric layer; and the inner cups 4 are located between the outer fabric layer and the inner fabric layer, and the rotary buckle 5 is arranged between the two inner cups 4 and is connected to the two inner cups 4 by means of the adjustment band 22.

The bra body 1 further comprises a bottom trim 9 which is made from a lacy elastic and stretchable fabric, and the back of the bra body 1 is an elastic structure without hooks and eyes.

Wearers wearing the bra can adjust the distance between the two inner cups 4 of the sports bra correspondingly according to the displacement of breasts caused by different intensities and amounts of exercise to improve breathability, such that the bra can effectively absorb moisture and release sweat and is suitable for women during exercise.

Embodiment 4

Figure 10:
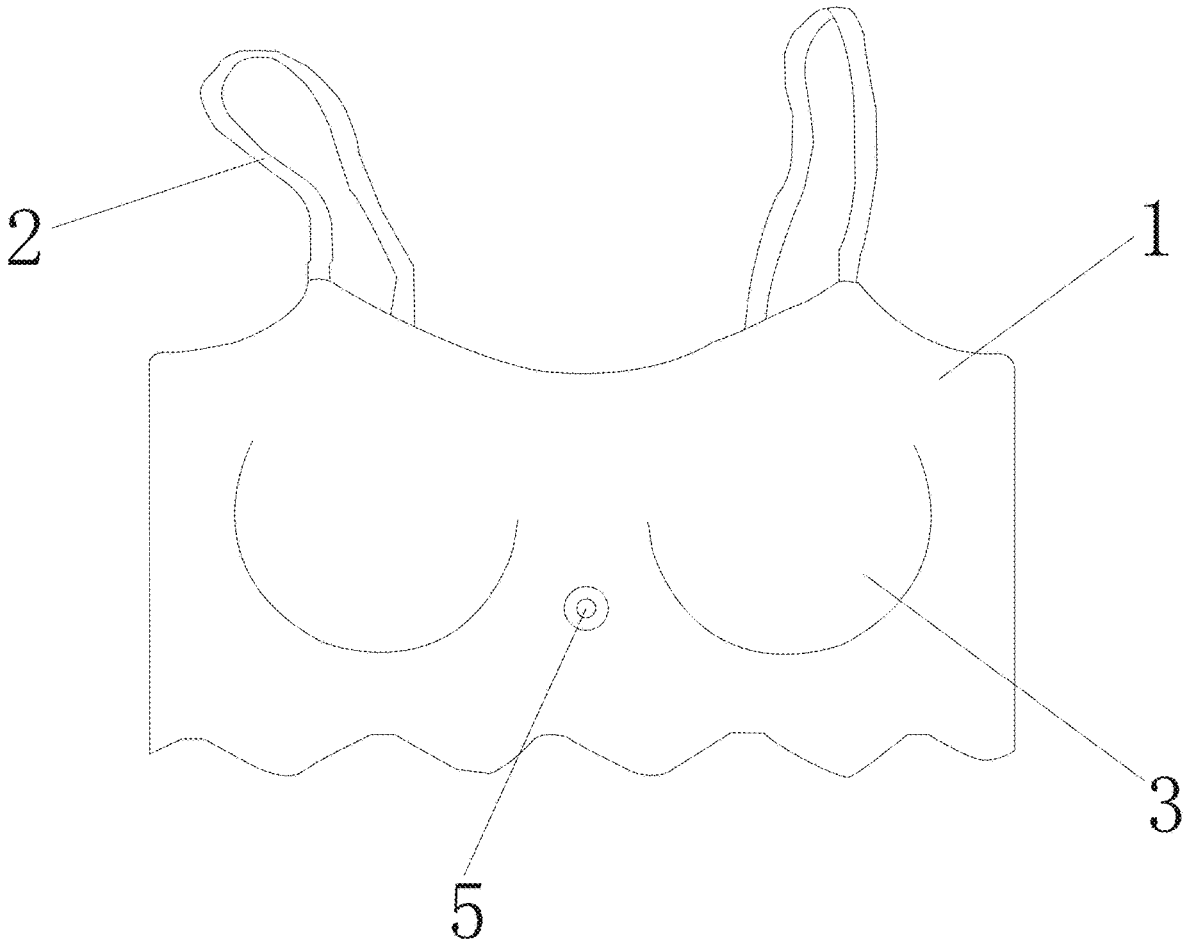
FIG. 10 is a first schematic structural view of Embodiment 4 of the invention.
Figure 11:
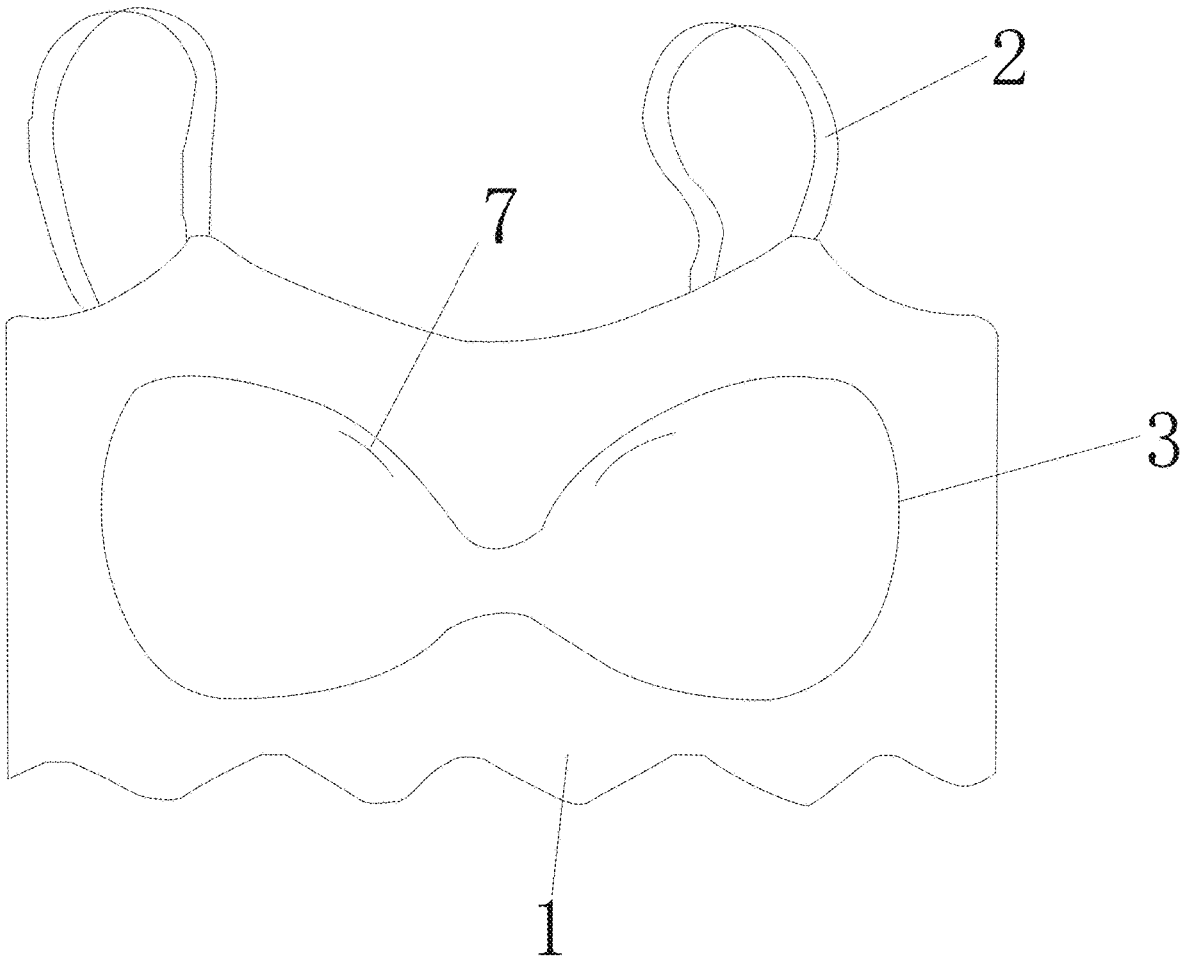
FIG. 11 is a second schematic structural view of Embodiment 4 of the invention.
Figure 12:
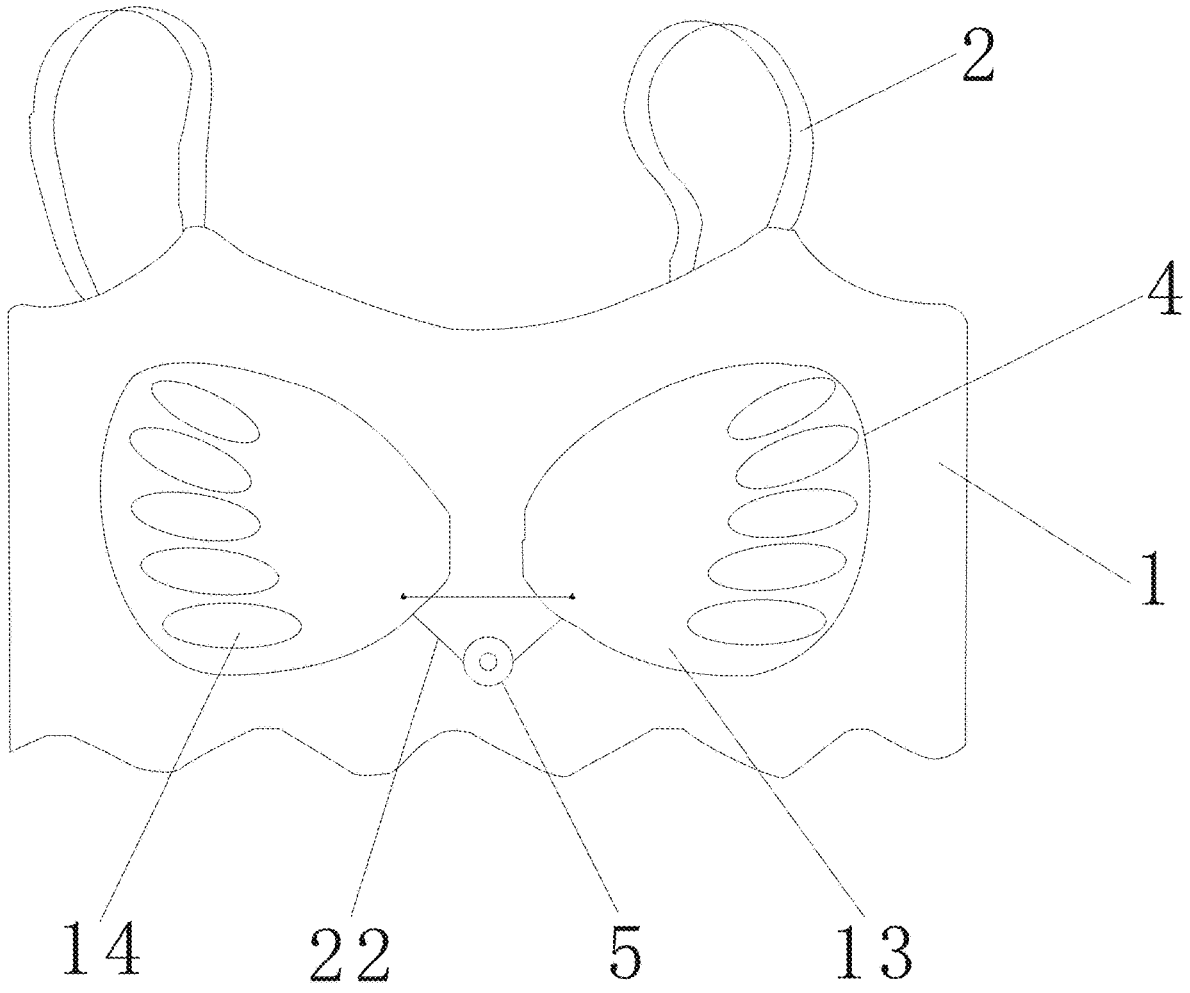
FIG. 12 is a third schematic structural view of Embodiment 4 of the invention.

As shown in FIG. 10-FIG. 12 which illustrate the structure of a bra in Embodiment 4. The bra in Embodiment 4 is suitable for women during sleep and is approximately identical in structure with Embodiment 1 (adopting the adjustment structure for the inner cups). Specifically, the bra in this embodiment comprises a bra body 1 and straps 2, wherein the bra body 1 comprises cup bodies 3 and has an outer fabric layer and an inner fabric layer; the inner cups 4 are located between the outer fabric layer and the inner fabric layer of the bra, and the rotary buckle 5 is arranged between the two inner cups 4.

Specifically, the back of the bra body 1 is an elastic structure without hooks and eyes, linings 13 are arranged on inner sides of the cup bodies 3, the inner cups 4 are arranged in the linings 13, and first openings 7 for placing in/taking out the inner cups 4 are formed in the inner sides of the cup bodies 3.

Wearers wearing the bra can adjust the distance between the cups of the sleep bra correspondingly according to the displacement of breasts caused by different sleeping postures and personal habits to improve breathability, such that the bra is suitable for women during sleep. Preferably, massage protrusions 14 are arranged on inner sides of the inner cups 4 in a fan shape, and the massage protrusions 14 are strip-shaped or spline-shaped.

It should be noted that in each of the embodiments described above, the outer fabric layer and the inner fabric layer are preferably made from modified cellulose fibers (also referred to as modal fibers); the inner cups 4 are preferably made from a spongy material; and the adjustment band 22 may be a metal adjustment band 22 or a nylon adjustment band 22.

The key design point of the invention is that by means of the specific arrangement of the bra, wearers wearing the bra do not need to take off the bra repeatedly for adjustment when the tightness of the bra is improper, and can adjust the bra to desired tightness by directly rotating the rotary buckle, such that operation is easy, the time for putting on and adjusting the bra is greatly shortened; and the bra provided by the application has the advantage of better wearing comfort.

The embodiments described above are merely preferred ones of the invention and are not intended to limit the technical scope of the invention. Any subtle amendments, equivalent transformations and modifications made to the above embodiments according to the technical essence of the invention still fall within the scope of the technical solution of the invention.

What is claimed is:

1. A bra with adjustable inner cups, comprising a bra body, wherein the bra body is provided with two inner cups and an adjustment assembly for adjusting a distance between the two inner cups, and the adjustment assembly comprises a shell, a take-up assembly and adjustment band; a rotary buckle is rotatably arranged at a top of the shell; the take-up assembly comprises an adjustment rod and a reel; the adjustment rod is rotatably arranged in the shell, and a top end of the adjustment rod is connected to the rotary buckle; the adjustment rod is in transmission connection with the reel, and two ends of the adjustment band are connected to the reel; a band body of the adjustment band is connected in series to the two inner cups;

the bra body has an outer fabric layer and an inner fabric layer, the two inner cups are arranged between the outer fabric layer and the inner fabric layer, and the outer fabric layer and the inner fabric layer are both made from regenerated cellulose fibers; and the adjustment band is a metal adjustment band or a nylon adjustment band.

2. The bra with adjustable inner cups according to claim 1, wherein the shell comprises a bottom shell and a top shell; the top shell covers the bottom shell; the rotary buckle is rotatably arranged on the top shell; a bottom of the adjustment rod is rotatably arranged on the bottom shell, and a top of the adjustment rod penetrates through the top shell to be in transmission connection with the rotary buckle; and a bottom of the reel is rotatably arranged on the bottom shell.

3. The bra with adjustable inner cups according to claim 2, wherein a transmission socket is arranged at a top of the top shell, and a limiting bump is arranged in the transmission socket; a plurality of limiting grooves are formed in a bottom of the rotary buckle in a circumferential direction; the limiting bump is slidably clamped in one of the limiting grooves; a V-shaped hole is formed in the transmission socket; the limiting bump is located on an inner side of a vertex of the V-shaped hole;

a band slot is formed in a side of the reel and provided with a seam connected to a track of the reel; the two ends of the adjustment band are both arranged in the band slot; and when the adjustment band is installed, the ends of the adjustment bands are knotted and then clamped in the band slot in an interference manner, then the adjustment band penetrates through the seam, and when taken up, the adjustment band rotates to be wound around the track of the reel.

4. The bra with adjustable inner cups according to claim 3, wherein first openings for placing in and taking out the inner cups are formed in an inner side of the bra body, and a second opening for placing in and taking out of the rotary buckle is formed in the bra body;

the bra body further comprises a bottom trim and hooks and eyes, the bottom trim is made from an elastic fabric, connecting portions are arranged between the cup bodies and the hooks and eyes, and air holes are formed in the connecting portions.

5. The bra with adjustable inner cups according to claim 4, wherein decorative lace is arranged at the second opening of the bra body.

6. The bra with adjustable inner cups according to claim 5, wherein massage protrusions are arranged on inner sides of the inner cups in a fan shape, and the massage protrusions are strip-shaped or spindle-shaped.

* * * * *